US005868591A

United States Patent [19]

Kleeman et al.

[11] Patent Number: 5,868,591

[45] Date of Patent: Feb. 9, 1999

[54] SWIVEL LOCK FOR OUTBOARD MOTOR

[75] Inventors: Robert Kleeman, Fond du Lac; James M. Schiek, Omro, both of Wis.

[73] Assignee: Brunswick Corporation, Lake Forest, Ill.

[21] Appl. No.: 974,787

[22] Filed: Nov. 20, 1997

[51] Int. Cl.[6] ..... B63H 5/12

[52] U.S. Cl. ..... 440/53; 440/900; 114/172

[58] Field of Search ..... 440/53, 55, 900; 114/172; 74/480 B, 497, 527

[56] References Cited

U.S. PATENT DOCUMENTS 1,451,452 4/1923 Williams ..... 74/480 B
3,382,837 5/1968 Aumack ..... 440/55
4,521,201 6/1985 Watanabe ..... 440/55

*Primary Examiner*—Ed L. Swinehart
*Attorney, Agent, or Firm*—William D. Lanyi

[57] ABSTRACT

First and second latch mechanisms are provided that allow a boat operator to prevent the moveable and stationary portions of an outboard from moving relative to each other. This device can be used during shipping, transportation, or use of an outboard motor in conjunction with a sailboat in which the rudder of the sailboat is used for steering, and it is desirable to maintain the moveable and stationary portions of an outboard motor rigidly with respect to each other. A first latch mechanism is attached to the moveable portion of the outboard motor, and a second latch mechanism is attached to the stationary portion of an outboard motor. The second latch mechanism is rotatable to place a receptacle into a region where a locking device can retain it.

12 Claims, 7 Drawing Sheets

SWIVEL LOCK FOR OUTBOARD MOTOR

BACKGROUND OF THE INVENTION

1. Field of the Invention

The present invention is generally related to a swivel lock for an outboard motor and, more particularly, to a latching device which permits a rotatable portion of an outboard motor to be rigidly locked in place relative to a stationary portion of the outboard motor.

2. Description of the Prior Art

Outboard motors are well-known to those skilled in the art and are available in many different types and horsepower ratings. Certain outboard motors, usually of low to medium horsepower ratings, are provided with a tiller handle that can be used to manually control the throttle of the motor and to steer the motor by rotating a moveable portion of the outboard motor relative to a stationary portion of the outboard motor which is rigidly attached to the transom of a boat. Outboard motors with larger horsepower ratings are typically associated with a steering mechanism that allows a boater to use a steering wheel and a steering cable assembly to cause the moveable portion of the outboard motor to rotate relative to the stationary portion.

In certain applications, it is highly desirable to have the capability of locking the moveable portion of the outboard motor in place relative to the stationary portion of the outboard motor. For example, when an outboard motor is shipped from the factory where it is manufactured to various dealerships which sell the motors, it is typically necessary to provide additional brackets and hardware to prevent the moveable portion of the outboard motor from moving relative to its stationary portion during shipping.

On occasion, sailboats are provided with an outboard motor which is rigidly attached to its transom. It is generally preferable to steer the sailboat through the use of its own rudder even when the outboard motor is used as the propulsion device. When operated in this way, it is necessary to prevent the moveable portion of the outboard motor from moving relative of the stationary portion. Normally, when a sailboat is operated in this manner, the outboard motor is locked into a straight ahead position and the boat is steered through the use of its own rudder without any change in the relative positions between the moveable and stationary portions of the outboard motor.

Certain types of fishing utilize a technique referred to as trolling. It is beneficial for certain types of boats, such as walleye boats, to be provided with a means to maintain an outboard motor in a fixed position which causes the boat to move straight ahead while the fishermen in the boat are trolling. In these types of applications, it would also be beneficial if the outboard motor could quickly be converted to full steering capability for short periods of time in order to allow the boat to be maneuvered to a different location where further trolling can be performed.

There are many applications where a marine vessel is provided with an additional, or kicker, outboard motor. Sometimes the kicker motor is used as a backup motor for use in emergencies when the main motor is unavailable for use. When not in use, the extra outboard motor should be held in a stationary manner so that it does not rotate back and forth about its pivot as a result of movements of the boat to which it is attached.

Occasionally during transit on highways, when a boat is transported on a towed boat trailer, it is beneficial to prevent the moveable and stationary portions of the outboard motor from moving relative to each other while the boat is being towed.

For the reasons described above, it would be highly beneficial if a simple means could be provided as part of the outboard motor which allows the operator to lock the moveable and stationary portions together without the need to assemble brackets and clamps to the outboard motor for these purposes.

SUMMARY OF THE INVENTION

An outboard motor made in accordance with the present invention comprises a stationary portion which is rigidly attachable to a transom of a boat and a moveable portion pivotally attached to the stationary portion. Usually, the moveable portion of the outboard motor comprises an engine, a drive shaft housing, and a propeller that is rotatably supportive on the moveable portion. Furthermore, the stationary portion typically comprises at least one clamp to attach the outboard motor to the transom of a boat.

A preferred embodiment of the present invention further comprises a first latch member rigidly attached to the moveable portion and a second latch member rotatably attached to the stationary portion of the outboard motor.

The present invention incorporates a probe and a receptacle which is shaped to receive the probe. These elements can operate as a detent or locking mechanism. It should be understood that the probe can be movably attached to either one of the first and second latch members with the receptacle being rigidly attached to the other. The probe is moveable in relation to the receptacle in response to the first latch member moving into contact with the second latch member for the purpose of causing the first and second latch members to cooperatively prevent the moveable portion from rotating relative to the stationary portion.

In a most preferred embodiment of the present invention, the first latch member is rigidly attached to the moveable portion of the outboard motor and comprises a detent latching mechanism while the second latch member is rotatably attached to the stationary portion of the outboard motor and comprises a detent which is shaped to receive the detent latching mechanism in retaining relation therein. In order to facilitate the use of the present invention, a boat operator can easily raise the second latch member with one hand and rotate it about a tilt tube of the outboard motor to cause a detent to move into contact with the detent latching mechanism which is attached to the first latch member. Alternatively, instead of using a detent mechanism, the first latch member can be provided with a slideable rod that can be moved into an aperture in a portion of the second latch member. These and alternative arrangements of the present invention can be employed to lock the moveable portion of the outboard motor into position relative to the stationary portion for the reasons described above.

BRIEF DESCRIPTION OF THE DRAWINGS

The present invention will be more fully and completely understood from a reading of the description of the preferred embodiment in conjunction with the drawings, in which.

DESCRIPTION OF PREFERRED EMBODIMENT

Figure 1:
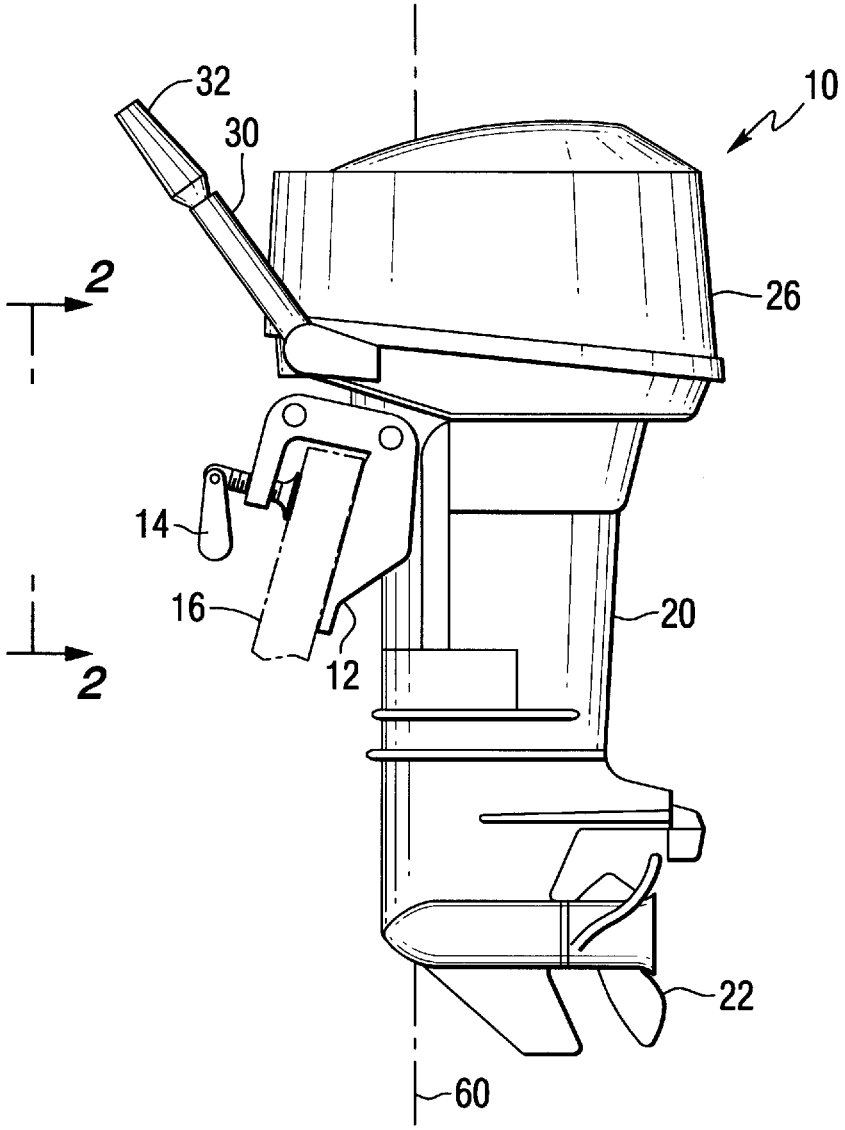
FIG. 1 PRIOR ART
FIG. 1 shows a side view of a known type of outboard motor attached to a transom of a boat.

Throughout the description of the preferred embodiment of the present invention, like components will be identified by like reference numerals.

FIG. 1 shows a typical outboard motor that is generally well-known to those skilled in the art. The outboard motor comprises a stationary portion which includes the clamp bracket 12 and the fastening screws 14 which allow the outboard motor 10 to be rigidly attached to the transom 16 of a boat. The stationary portion also includes various other components which are not shown in FIG. 1, but which allow for the rotatable support of the moveable portion of the outboard motor. The moveable portion comprises a drive shaft housing 20 which supports a rotatable propeller 22 and an internal combustion engine (not shown in FIG. 1) which is located under the cowl 26. To steer the boat on which the outboard motor is attached, the tiller handle 30 is manually moved to cause rotation of the moveable portion about a centerline 60 defined by components of the stationary portion of the outboard motor. Reference number 32 identifies a hand grip that can be used as a throttle control for the engine.

Figure 2:
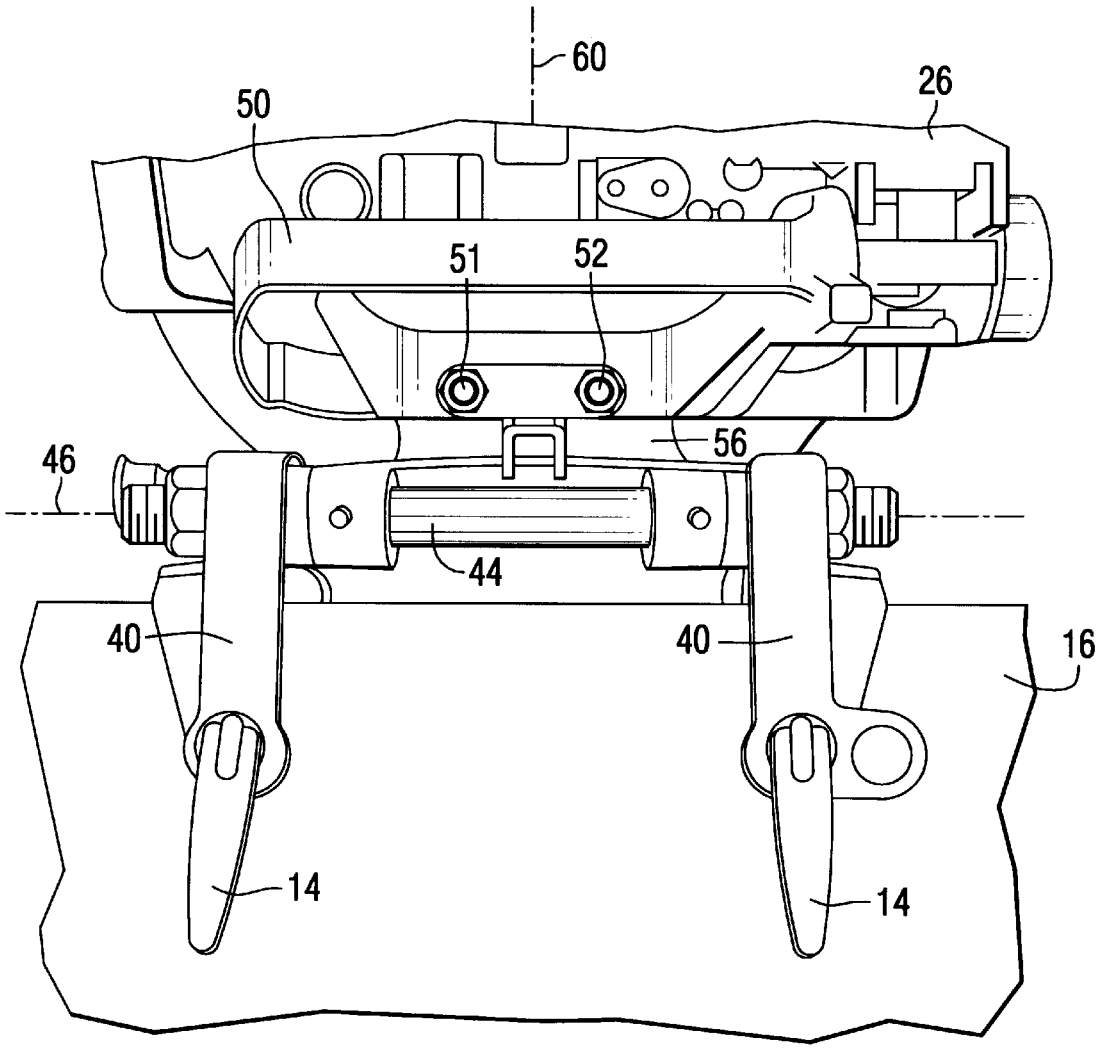
FIG. 2 PRIOR ART
FIG. 2 is a partial view of the known outboard motor of FIG. 1.

FIG. 2 is a partial view of FIG. 1, showing the region of the outboard motor where the present invention is intended to be used. The screw clamps 14 are supported by a clamp bracket 40. Rigidly attached to the clamp bracket 40 is a tilt tube 44 which defines an axis 46 about which the rotatable portion of the outboard motor can be tilted. A lifting handle 50 is attached to the moveable portion of the outboard motor by two bolts identified by reference numerals 51 and 52. Reference numeral 56 identifies a swivel head of the present invention. With reference to FIGS. 1 and 2, line 60 represents the general location of the axis about which the moveable portion of the outboard motor can swivel relative to the stationary portion of the outboard motor during steering maneuvers.

When it is necessary to maintain the constant position of the moveable portion of the outboard motor relative to its stationary portion, it would be significantly beneficial if a simplified attachment mechanism could be employed manually without the need for additional components to be assembled and attached to the outboard motor.

Figure 3:
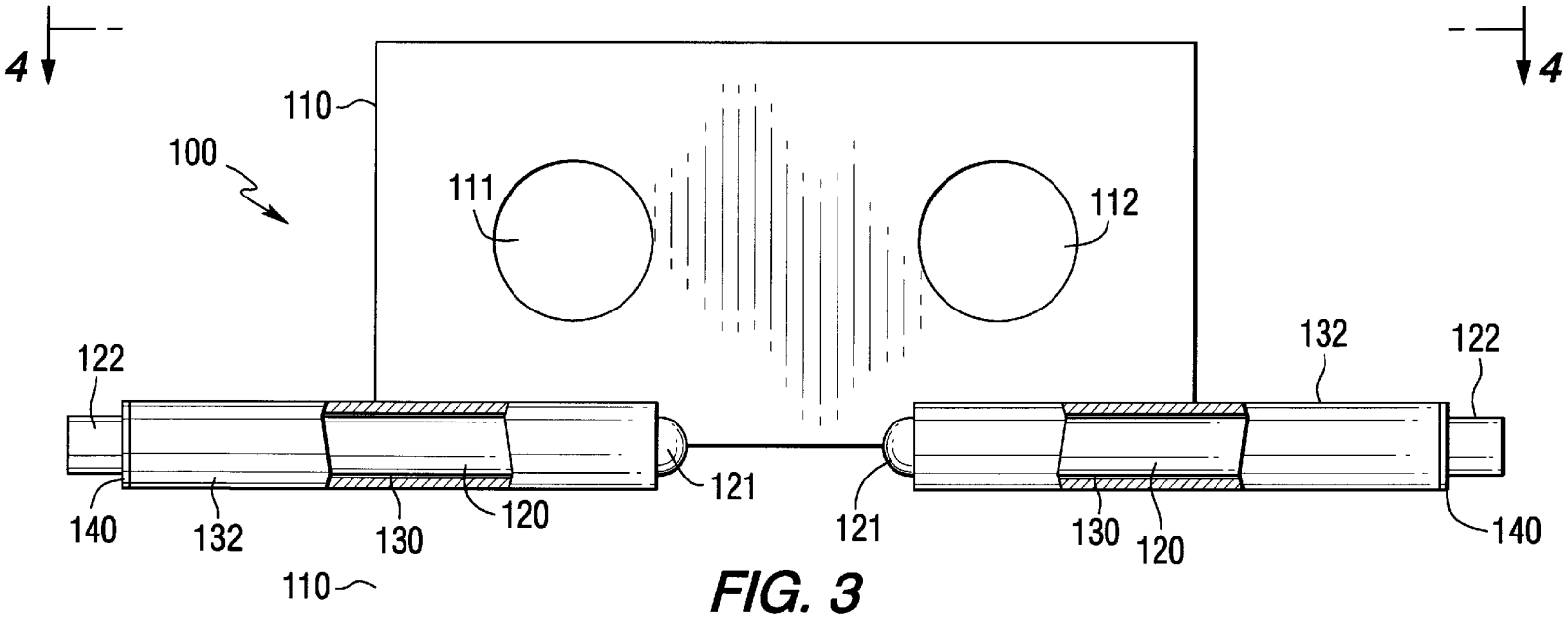
FIG. 3 shows a first latch member of the present invention.

FIG. 3 shows a first latch member 100 which can be attached to the moveable portion of the outboard motor by clamping the support plate 110 to the moveable portion of the outboard motor by using bolts 51 and 52, connecting them through holes 111 and 112, respectively. The first latch member 110 further comprises a probe 120 which has a first end 121 and a second end 122. In FIG. 3, the embodiment of the present invention is provided with two probes 120 which each have a first end 121 and a second end 122. The probes are axially moveable within the cylindrical openings 130 of their respective holding tubes 132. These probes 120 can be spring loaded to maintain them, with a predetermined force, in a position that extends the tip, or first end 121, in the positions shown in FIG. 3, toward the center space between the holding tubes 132. In association with the spring (not shown in FIG. 3), a snap ring 140 can be used to limit the travel of the probes 120 in a direction towards each other in FIG. 3.

Figure 4:
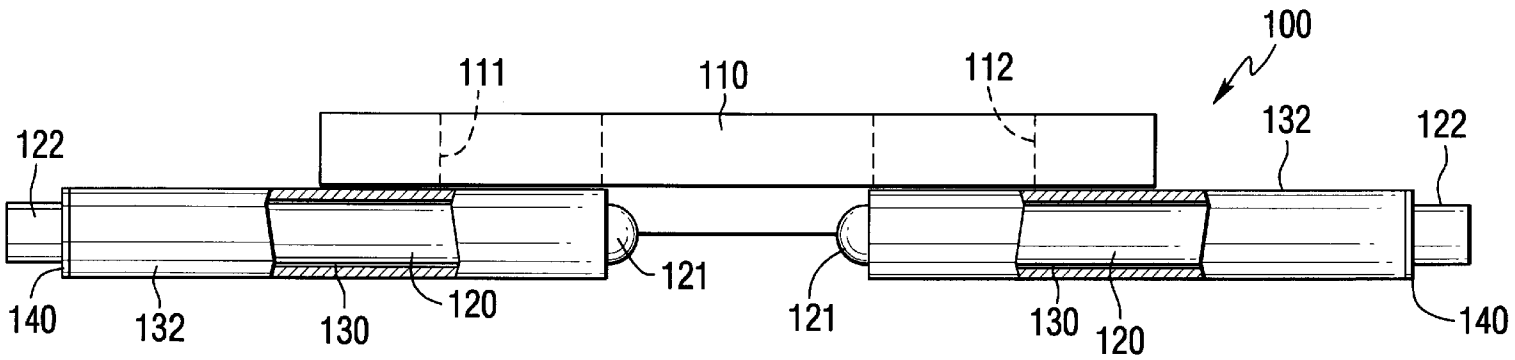
FIG. 4 is an alternative view of FIG. 3.

With continued reference to FIG. 3, it should be clearly understood that the present invention does not always require the provision of two probes 120 in all applications. For example, it has been determined that a single probe suffices in many cases. FIG. 4 is an alternative view of the present invention shown in FIG. 3.

The tubes 132 are attached to the support plate 110 of the first latch member. In one embodiment of the present invention, the tubes 132 and the support plate 110 are made of aluminum and welded together to maintain the arrangements shown in FIGS. 3 and 4.

Figure 5:
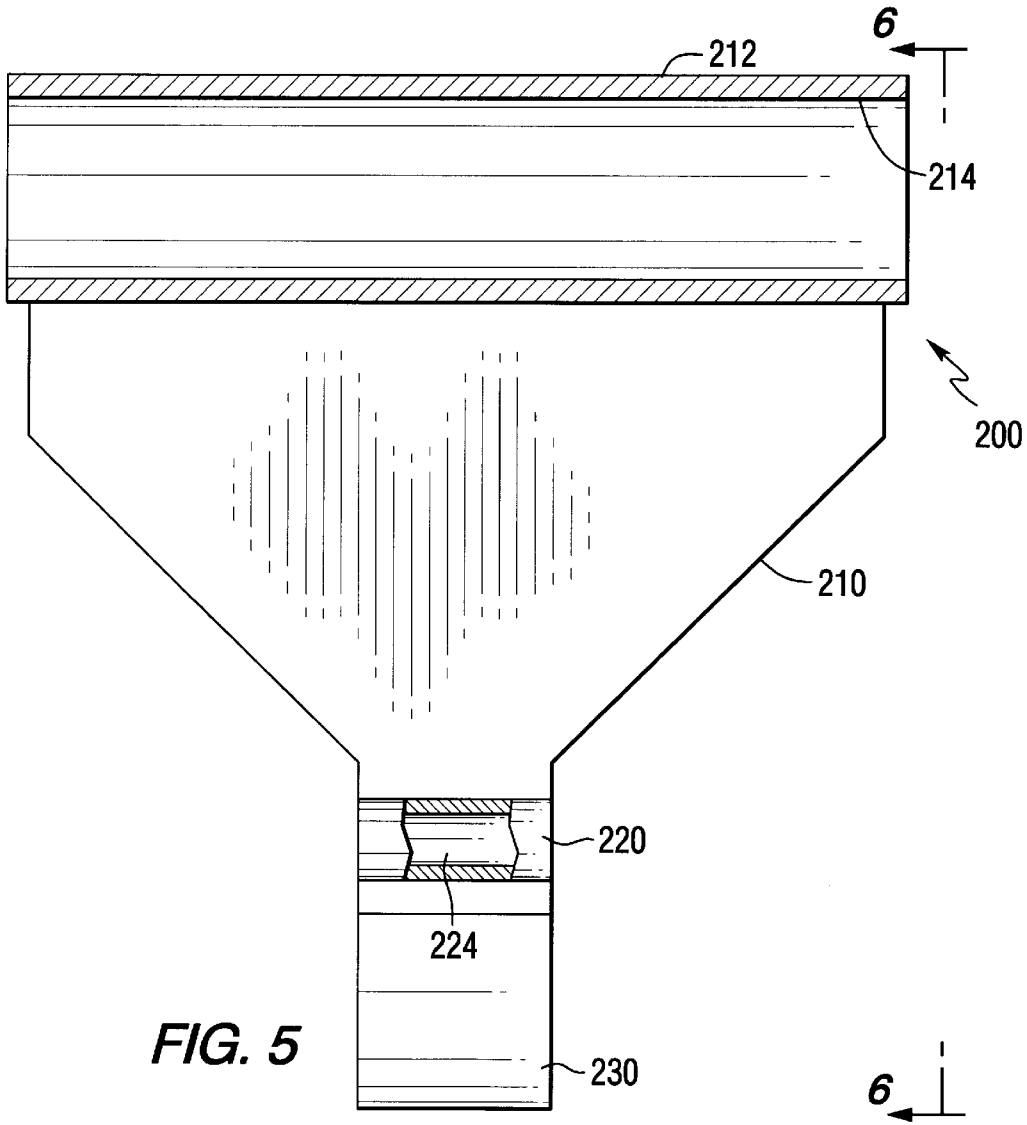
FIG. 5 shows a second latch member of the present invention.

As shown in FIG. 5, a second latch member 200 comprises a plate 210 to which a swivel lock tube 212 is attached. The swivel lock tube 212 is shaped to receive the tilt tube 44 which is shown in FIG. 2. A slight clearance is provided between the inner cylindrical surface 214 of the swivel lock tube 212 and the outer cylindrical surface of the tilt tube 44. This allows the second latch member 200 to rotate about centerline 46 shown in FIG. 2.

With continued reference to FIG. 5, a receptacle 220 is attached to the second latch member. An aperture 224 of the receptacle 220 is shaped to receive the probe 120 described above in conjunction with FIGS. 3 and 4. It should be understood that in certain applications of the present invention the aperture 224 need not extend completely through the receptacle 220. The receptacle 220 is rigidly attached to the second latch member 200. An extension portion 230 of the second latch member 200 is provided to facilitate the manual rotation of the second latch member relative to centerline 46.

Figure 6:
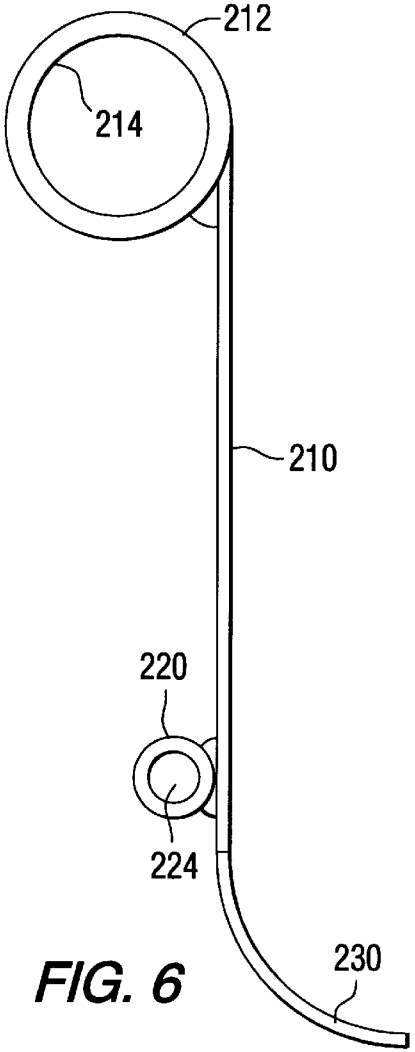
FIG. 6 is an alternative view of FIG. 5.

FIG. 6 is a side view of the second latch member 200. The plate 210 is rigidly attached to the swivel lock tube 212 and the receptacle 220 in order to maintain the relative positions thereof. When the second latch member 200 is rotated about centerline 46 shown in FIG. 2, the receptacle 220 swings around the centerline at a distance defined by the relative dimensions of the components of the second latch member 200. These dimensions cause the receptacle to move into contact with the first latch member 100 described above in conjunctions with FIGS. 3 and 4. More particularly, this movement causes the aperture 224 to move into contact with the first end 121 of the probe 120 and, as a result, allows the first ends of the probes 120 to move into the aperture 224 and retain the second latch member 200 in position. As a result of this maintenance of the second latch member in position relative to the first latch member, the presence of the receptacle 220 in the space between the facing ends of tubes 132 prevents any rotation of the moveable portion of the outboard motor relative to the stationary portion of the outboard motor.

Figure 7:
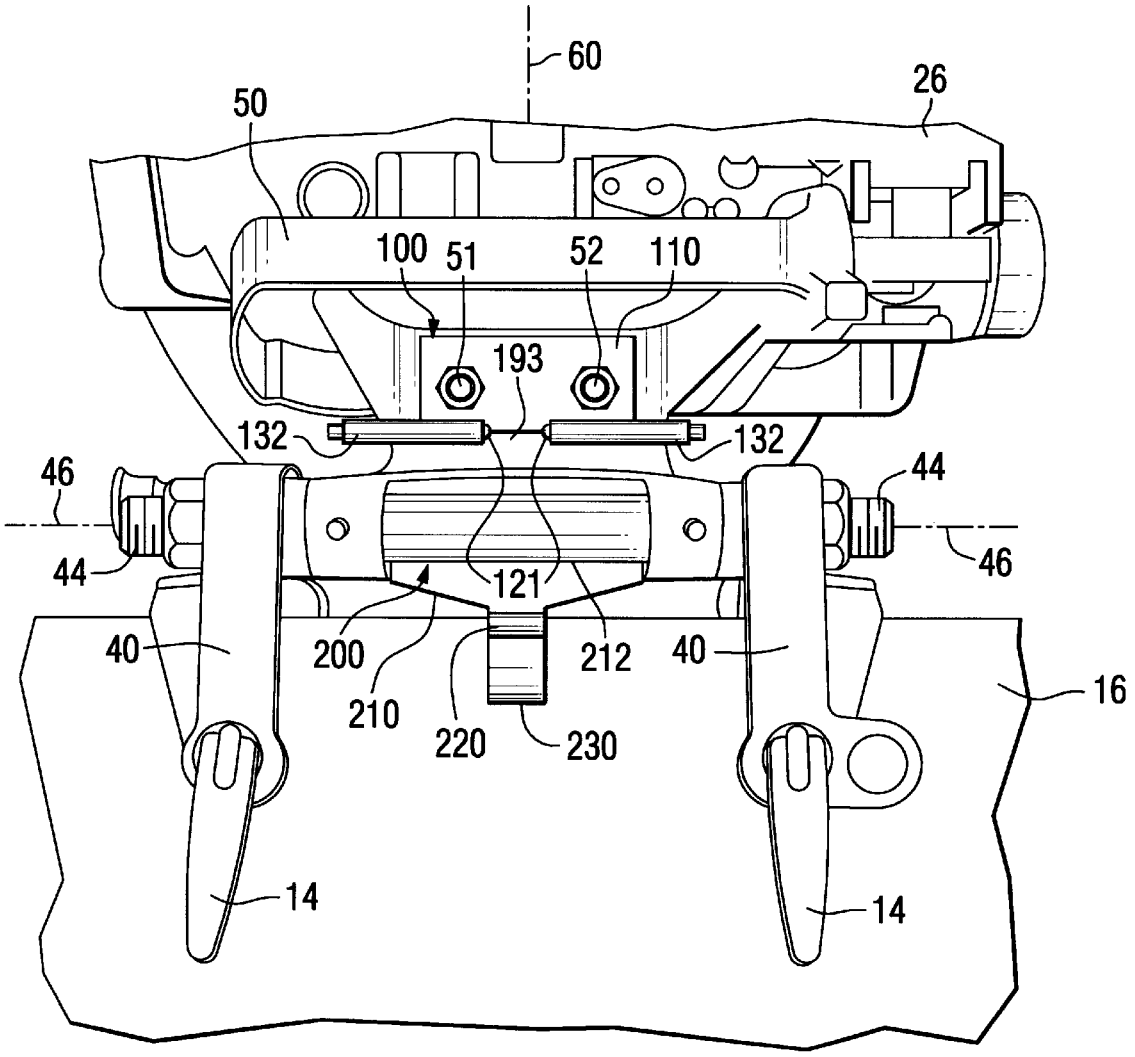
FIG. 7 shows the outboard motor of FIG. 2 with the present invention attached to the stationary and moving portions of the outboard motor.

FIG. 7 shows the first and second latch members, 100 and 200, of the present invention assembled in association with an outboard motor such as that shown in FIG. 2. The first latch member 100 is attached to the handle 50 by bolts 51 and 52. It should be understood that, although the first latch member 100 is attached to the handle 50 in the type of outboard motor selected for illustration in FIG. 7, alternative locations on the moveable portion of the outboard motor are also possible for use in connecting the first latch member 100 to the moveable portion of the outboard motor.

The second latch member 200 is attached to the stationary portion of the outboard motor by disposing the swivel lock tube 212 around the tilt tube 44. In the position shown in FIG. 7, the moveable portion of the outboard motor is free to swivel about line 60 as the operator steers the boat. This will cause the gap 193, between the two tubes 132, to move left and right in FIG. 7. When the operator desires to lock the moveable portion of the outboard motor and prevent further movement about centerline 60, the second latch member 200 can be rotated about centerline 46 of the tilt tube 44 by manually lifting its end 230 until the receptacle 220 moves into the gap 193 between the two tubes 132 of the first latch member 100. The presence of the receptacle 220 in the gap between the two tubes 132 prevents further rotation of the moveable portion about centerline 60. The receptacle 220 is retained in this locking position by the cooperative action of the first ends 121 of the probes 120 and the aperture 224 of the receptacle 220, as shown in FIGS. 5 and 6.

Figure 8:
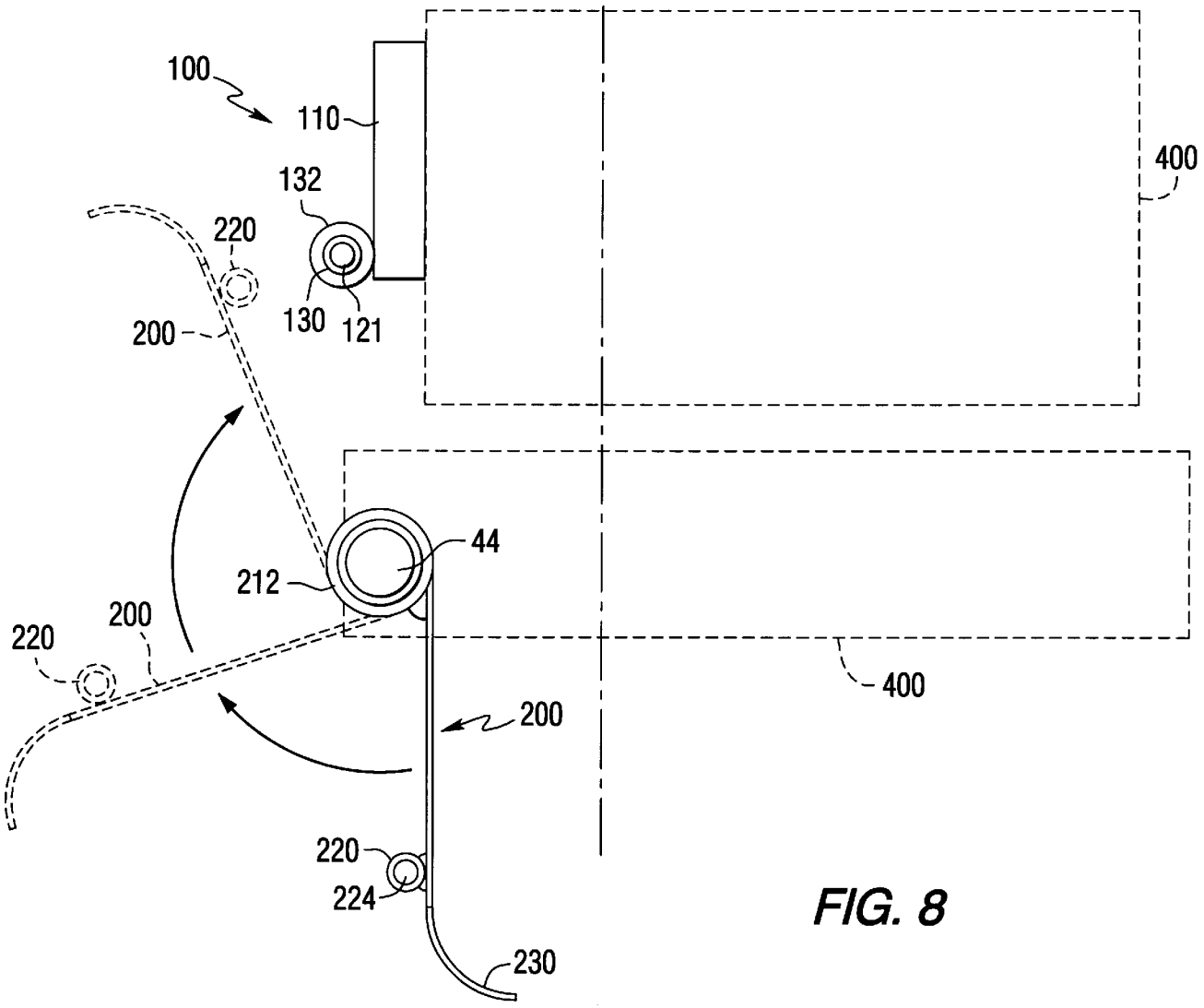
FIG. 8 shows the first and second latch members of the present invention associated together to illustrate the operation.

FIG. 8 is a highly simplified schematic representation of the operation by which a boat operator can manually lock the moveable and stationary portions of the outboard motor together to prevent relative movement therebetween. In FIG. 8 dashed box 400 represents the moveable portion of the outboard motor, and dashed box 402 represents the stationary portion of the outboard motor. As described above, the moveable portion 400 typically comprises the internal combustion engine, the drive shaft housing, the propeller, a skeg, an anticavitation cauitation plate, and a cowl disposed over the engine. The stationary portion of the outboard motor typically comprise the clamp bracket, clamp screws 14, and the tilt tube 44. For purposes of clarity, these various components are represented by dashed boxes in FIG. 8. Support plate 110 of the first latch member 100 is attached to the moveable portion 400 so that the tubes 132 are in position to receive the receptacle 220 in the gap between them. For purposes of clarity in FIG. 8, only the left most tube 132 in FIG. 3 is shown in FIG. 8. In effect, the representation of the first latch member 100 in FIG. 8 is equivalent to a section taken through its vertical centerline in FIG. 3, looking toward the left. The first end 121 of the probe 120 is visible in FIG. 8, disposed in the cylindrical opening 130 of tube 132.

As the second latch member is rotated about the tilt tube 44, the receptacle 220 swings in an arc as represented by the solid line illustration of the second latch member 200 and the two dashed line representations. This causes the receptacle 220 to swing into position between the two tubes 132 of the first latch member 100. Because of the spring action exerted against the probe 120, the first ends 121 of the two probes move into the aperture 224 of the receptacle 220 after they are initially pushed into their tubes 132 against the resistance of their respective springs. This action operates as a detent which holds the second latch member 200 in position relative to the first latch member 100 until the operator exerts a force to reverse the operation represented in FIG. 8.

Figure 9:
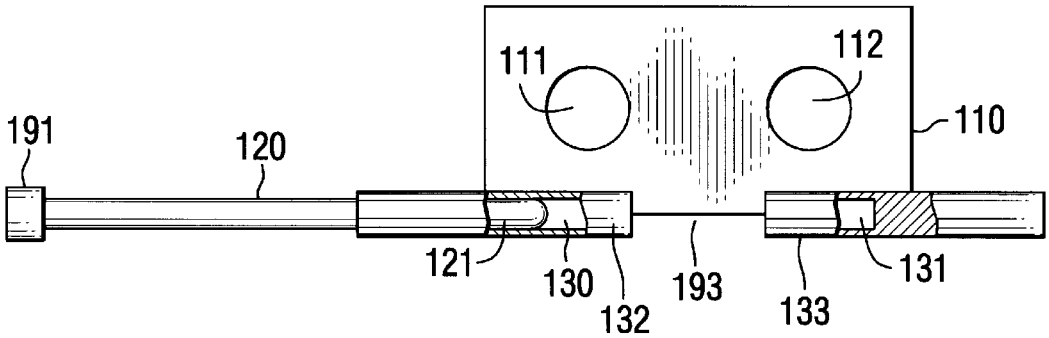
FIG. 9 shows an alternative configuration of the first latch member of the present invention.
Figure 10:
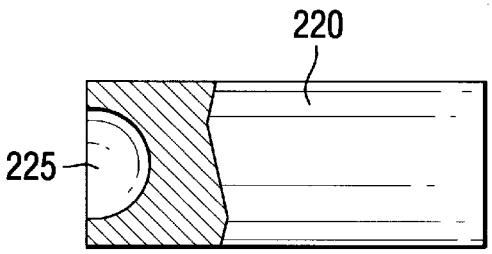
FIG. 10 shows an alternative configuration of a receptacle used in conjunction with the second latch member of the present invention.

FIGS. 9 and 10 show two possible alterations that can be made to adapt the present invention for a slightly different operation. In FIG. 9, the two tubes 132 are not provided with two probes 120 that operate cooperatively as described above in conjunction with FIGS. 3 and 4. Instead, a spring loaded probe 120 can be manually pulled toward the left by a knob 191 to retract the first end 121 from the space 193 between the tube 132 and the partial tube 133. When the knob 191 is released, the probe 120 moves towards the right under the force of the internal spring within the tube 132 and causes the first end 121 to move into the space 193 and through the aperture 224 of the receptacle 220, as described above. The first end 121 of the probe 120 then moves into the partial opening 131 in the second tube 133. This physically locks the receptacle 220 in place in the space 193 until the probe 120 is manually pulled toward the left to the position shown in FIG. 9. One advantage to the embodiment shown in FIG. 9 is that significant vibration can be withstood by the device without the second latch member 200 becoming disconnected from the first latch member 100. When the detents shown in FIGS. 3 and 4 are used and the first ends 121 are only inserted partially into the aperture 224 of the receptacle 220, extreme forces might be sufficient to cause the second latch member 200 to disconnect from the first latch member 100. The embodiment shown in FIG. 9 prevents this possibility.

FIG. 10 shows a modified receptacle 220 which does not have an opening extending through its length. Instead, it has a relatively small indentation 225 in one of its ends to receive the first end 121 of the probe 120.

It should also be noted that only one indentation 225 is provided in the receptacle 220. Therefore, only one probe 120 would be provided and no probe 120 would be included within the tube 132 shown in FIGS. 3 and 4. It should be clearly understood that many slight variations of the basic invention can be employed within the various embodiments that are possible. For example, throughout the description of the preferred embodiment of the present invention, the first latch member 100 has been described as being attached to the moveable portion of the outboard motor that is pivotally attached to a stationary portion of the outboard motor. The second latch member 200 has been described as being attached to the stationary portion of the outboard motor. While this arrangement is preferable in many applications, it should be understood that the reverse situation is also within the scope of the present invention. In other words, the latch member illustrated in FIGS. 3 and 4, with the detents or other means for holding the other latch member in place, could be attached to the stationary portion of the outboard motor which is fastened to the transom of a boat. Similarly, the latch member illustrated in FIGS. 5 and 6 could be attached to the moveable portion of the outboard motor which includes its cowl, powerhead and other components that swivel in response to steering maneuvers. Nothing in the characteristics of the present invention prohibit this alternative arrangement.

Many other embodiments are within the scope of the present invention, such as the inclusion or omission of additional fastening techniques to hold the two latch members together when the operator has moved them into contact with each other. These include spring loaded detent mechanisms, hand operated latches and other means for holding the two latch members together. In addition, it should be understood that the second latch member 200 illustrated in FIGS. 5 and 6 could be provided with a spring return that maintains it in an unlatching position unless an operator intentionally rotates the second latch member 200 about the axis of rotation to lock it into position with respect to the first latch member 100.

We claim:

1. An outboard motor, comprising:

a stationary portion which is rigidly attachable to a transom of a boat;

a movable portion pivotally attached to said stationary portion;

a first latch member rigidly attached to said movable portion;

a second latch member rotatably attached to said stationary portion;

a probe movably attached to a preselected one of said first and second latch members;

a receptacle rigidly attached to another of said first and second latch members, said probe being movable in relation to said receptacle in response to said first latch member moving into contact with said second latch member for the purpose of causing said first and second latch members to cooperate with each other to prevent said movable portion from rotating relative to said stationary portion, said stationary portion comprising at least one clamp to attach said outboard motor to said transom of said boat, said movable portion comprising an engine, a drive shaft housing, and a propeller rotatably supported on said movable portion, said first latch member comprising a movable rod and said second latch member comprising an aperture shaped to receive said movable rod in retaining relation therein.

2. The outboard motor of claim 1, wherein: said second latch member is rotatably connected around a tilt tube of said outboard motor.

3. An outboard motor, comprising:

a stationary portion which is rigidly attachable to a transom of a boat;

a movable portion pivotally attached to said stationary portion, said stationary portion comprising at least one clamp to attach said outboard motor to said transom of said boat, said movable portion comprising an engine, a drive shaft housing, and a propeller rotatably supported on said movable portion;

a first latch member rigidly attached to said movable portion;

a second latch member rotatably attached to said stationary portion;

a probe movably attached to a preselected one of said first and second latch members;

a receptacle rigidly attached to another of said first and second latch members, said probe being movable in relation to said receptacle in response to said first latch member moving into contact with said second latch member for the purpose of causing said first and second latch members to cooperate with each other to prevent said movable portion from rotating relative to said stationary portion.

4. The outboard motor of claim 3, wherein:

said first latch member comprises a detent latching mechanism and said second latch member comprises a detent shaped to receive said detent latching mechanism in retaining relation therein.

5. The outboard motor of claim 3, wherein:

said second latch member comprises a detent latching mechanism and said first latch member comprises a detent shaped to receive said detent latching mechanism in retaining relation therein.

6. The outboard motor of claim 3, wherein:

said second latch member comprises a movable rod and said first latch member comprises an aperture shaped to receive said movable rod in retaining relation therein.

7. The outboard motor of claim 3, wherein:

said first latch member comprises a movable rod and said second latch member comprises an aperture shaped to receive said movable rod in retaining relation therein.

8. The outboard motor of claim 3, wherein:

said second latch member is rotatably connected around a tilt tube of said outboard motor.

9. The outboard motor of claim 8, wherein:

said first latch member is attached to a handle which is attached to said movable portion.

10. An outboard motor, comprising:

a stationary portion which is rigidly attachable to a transom of a boat;

a movable portion pivotally attached to said stationary portion, said stationary portion comprising at least one clamp to attach said outboard motor to said transom of said boat, said movable portion comprising an engine, a drive shaft housing, and a propeller rotatably supported on said movable portion;

a first latch member rigidly attached to said movable portion;

a second latch member rotatably attached to said stationary portion;

a probe movably attached to a preselected one of said first and second latch members;

a receptacle rigidly attached to another of said first and second latch members, said probe being movable in relation to said receptacle in response to said first latch member moving into contact with said second latch member for the purpose of causing said first and second latch members to cooperate with each other to prevent said movable portion from rotating relative to said stationary portion, said first latch member comprising a detent latching mechanism and said second latch member comprises a detent shaped to receive said detent latching mechanism in retaining relation therein.

11. The outboard motor of claim 10, wherein:

said second latch member is rotatably connected around a tilt tube of said outboard motor.

12. The outboard motor of claim 11, wherein:

said first latch member is attached to a handle which is attached to said movable portion.

* * * * *